US007854039B2

(12) United States Patent
Lee et al.

(10) Patent No.: US 7,854,039 B2
(45) Date of Patent: Dec. 21, 2010

(54) HANDLE ASSEMBLY ROTATABLE IN ALL DIRECTIONS AND CLEANER HAVING THE SAME

(75) Inventors: Hyun-ju Lee, Gwangju (KR); Hwa-gyu Song, Gwangju (KR); Jea-won Lee, Hwaseong-si (KR); Jeoung-kyo Jeoung, Yongin-si (KR); Hee-cheon You, Pohang-si (KR); Ki-hyo Jung, Gyeongsangbuk-do (KR); Joon-ho Chang, Suwon-si (KR); Won-sup Lee, Gyeongju-si (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 402 days.

(21) Appl. No.: 12/153,178

(22) Filed: May 14, 2008

(65) Prior Publication Data

US 2009/0158550 A1 Jun. 25, 2009

(30) Foreign Application Priority Data

Dec. 20, 2007 (KR) ..... 10-2007-0134708

(51) Int. Cl.
*A47L 9/32* (2006.01)

(52) U.S. Cl. ..... 15/410; 15/411; 15/22.1; 15/41.1; 15/49.1; 15/144.1; 15/229.6; 15/230.11; 15/DIG. 10

(58) Field of Classification Search ..... 15/410, 15/411, 344, 22.1, 41.1, 49.1, 144.1, 229.6, 15/230.11, DIG. 10; *A47L 9/32*
See application file for complete search history.

(56) References Cited

U.S. PATENT DOCUMENTS 4,492,830 A 1/1985 Kim

FOREIGN PATENT DOCUMENTS

| | | |
|---|---|---|
| JP | 11146851 | 6/1999 |
| KR | 0032727 | 7/1997 |
| KR | 010269 | 2/1999 |
| KR | 0019224 | 3/2002 |

*Primary Examiner*—David A Redding
(74) *Attorney, Agent, or Firm*—Blank Rome LLP

(57) ABSTRACT

A cleaner having a handle assembly rotatable in all directions is disclosed, the handle assembly including a housing; a handle which is capable of being gripped by a user; a connection unit which connects the handle with the housing to rotate in all directions; and an elastic unit which elastically biases the handle to a neutral position. As the handle is capable of rotating in all directions, a user can clean a surface without feeling strain in his or her joints.

14 Claims, 5 Drawing Sheets

HANDLE ASSEMBLY ROTATABLE IN ALL DIRECTIONS AND CLEANER HAVING THE SAME

CROSS-REFERENCE TO RELATED APPLICATIONS

This application claims priority under 35 U.S.C. §119 from Korean Patent Application No. 10-2007-0134708, filed on Dec. 20, 2007, in the Korean Intellectual Property Office, the disclosure of which is incorporated herein by reference in its entirety.

BACKGROUND OF THE INVENTION

1. Field of the Invention

The present disclosure relates to a vacuum cleaner, and more particularly, to a handle assembly rotatable in all directions and a vacuum cleaner having the same.

2. Description of the Related Art

A general cleaner includes a cleaner body, a brush assembly, a brush pipe, a flexible suction hose, and a handle assembly. The cleaner body generates a suction force for sucking dust-laden air by driving a motor mounted therein. The brush assembly travels along a surface being cleaned, and draws in dust-laden air from the surface. The drawn dust-laden air is transferred to a dust separating apparatus mounted in the cleaner body through the brush pipe extending from the brush assembly. The brush pipe is connected to the cleaner body using the flexible hose, which enables a user to conveniently clean an area. The handle assembly is mounted between the brush pipe and the suction hose, and includes a handle which a user may grip to manipulate the brush assembly. The user may clean a surface by gripping the handle and moving the brush assembly.

The cleaner handle is generally fixed in place, and thus does not rotate. That is, the cleaner handle is fixed to a brush pipe, so the cleaner handle moves along with the brush pipe. When a user cleans corners, the user may experience inconvenience in handling the long brush pipe, since the user needs to bend his or her wrist or elbow.

To solve the above problems, vacuum cleaners having a handle rotatable in a certain direction was disclosed. However, such vacuum cleaners also have the above problems, since the handle rotates in only one direction.

SUMMARY OF THE INVENTION

An aspect of the present disclosure is to address at least the above problems and/or disadvantages and to provide at least the advantages described below. Accordingly, an aspect of the present disclosure is to provide a handle assembly rotatable in all directions.

Another aspect of the present disclosure is to provide a vacuum cleaner having the handle assembly.

According to an exemplary aspect of the present invention, there is provided a handle assembly, including a housing; a handle which is capable of being gripped by a user; a connection unit which connects the housing with the handle to rotate in all directions; and an elastic unit which elastically biases the handle to a neutral position.

The connection unit may include a shaft which penetrates the handle; and a guide unit which houses the shaft in a rotatable manner.

The connection unit may further include a flange which is inserted into the guide unit, and is formed at both ends of the shaft.

The elastic unit may include four elastic members which are in contact with the handle.

The elastic member may be a leaf spring.

The elastic member may be a torsion spring.

The elastic member may be a compression spring.

According to an exemplary aspect of the present invention, there is provided a cleaner, including a brush assembly which contacts a surface being cleaned, and draws in dust-laden air from the surface; a brush pipe which extends from the brush assembly; and a handle assembly which is mounted on an end of the brush pipe, wherein the handle assembly includes a housing; a handle which is capable of being gripping by a use; a connection unit which connects the housing to the handle to rotate in all directions; and an elastic unit which elastically biases the handle to a neutral position.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS OF THE INVENTION

Figure 1:
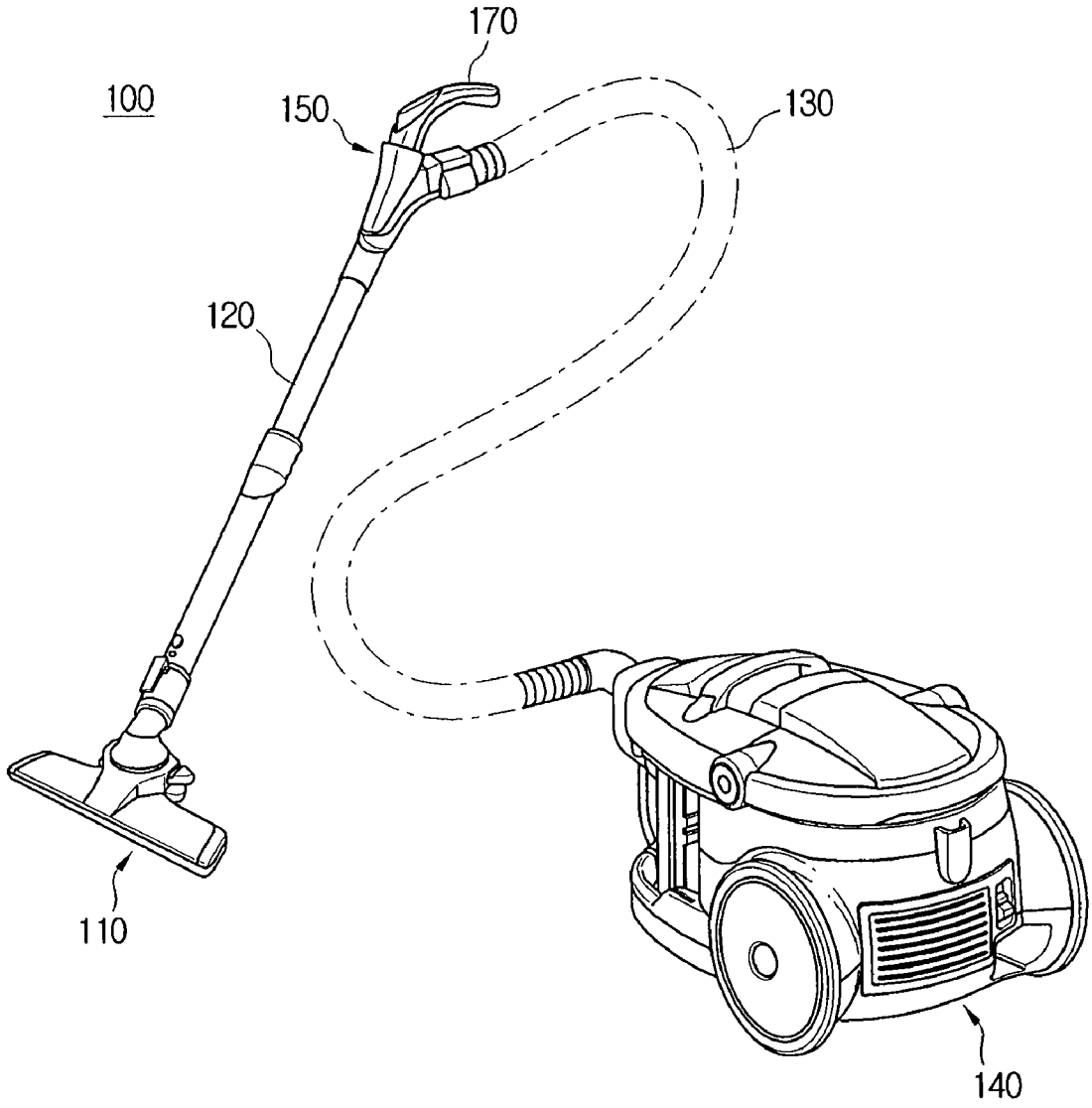
FIG. 1 is a perspective view of a vacuum cleaner according to an exemplary embodiment of the present invention.

Certain exemplary embodiments of the present invention will now be described in greater detail with reference to the accompanying drawings.

In the following description, same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

FIG. 1 is a perspective view of a vacuum cleaner according to an exemplary embodiment of the present invention.

A vacuum cleaner according to an exemplary embodiment of the present invention includes a brush assembly 110, a brush pipe 120, a flexible hose 130, a cleaner body 140, and a handle assembly 150.

The brush assembly 110 contacts a surface to be cleaned, and draws in dust-laden air from the surface. The drawn dust-laden air is transferred to the cleaner body 140 through the brush pipe 120 extending from the brush assembly 110, and through the flexible hose 130. A dust separating unit (not shown) mounted in the cleaner body 140 separates dust or other matter from air drawn in through the brush assembly 110. A motor (not shown) is mounted in the cleaner body 140 to generate a suction force to draw dust-laden air into the vacuum cleaner body 140 through the brush assembly 110.

The handle assembly 150 is disposed between the brush pipe 120 and the flexible hose 130. A user grips a handle 170 provided on the handle assembly 150, and manipulates the brush pipe 120 and the brush assembly 110 in order to clean the surface being cleaned.

Figure 2:
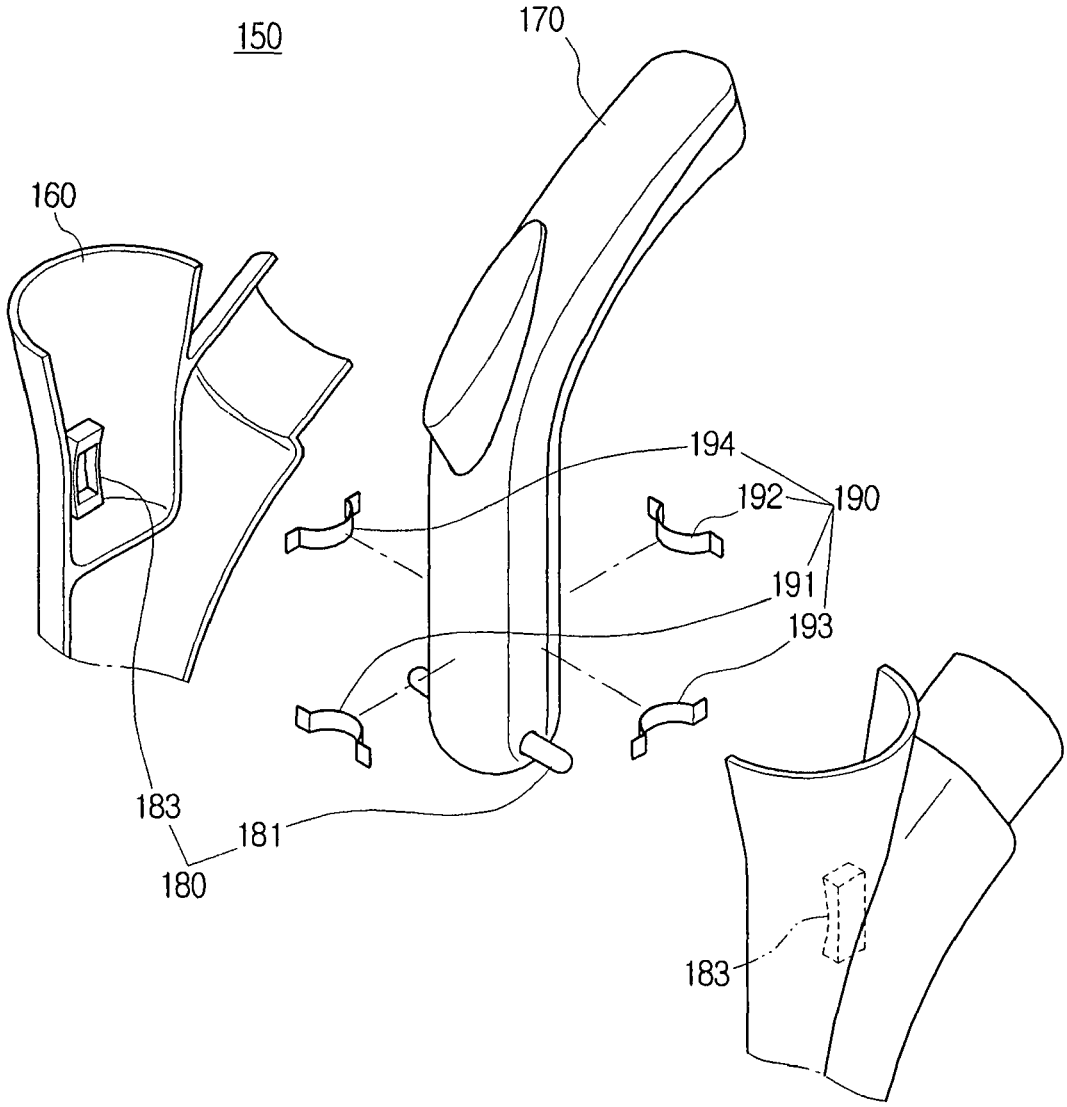
FIG. 2 is an exploded perspective view of a handle assembly according to an exemplary embodiment of the present invention.
Figure 3:
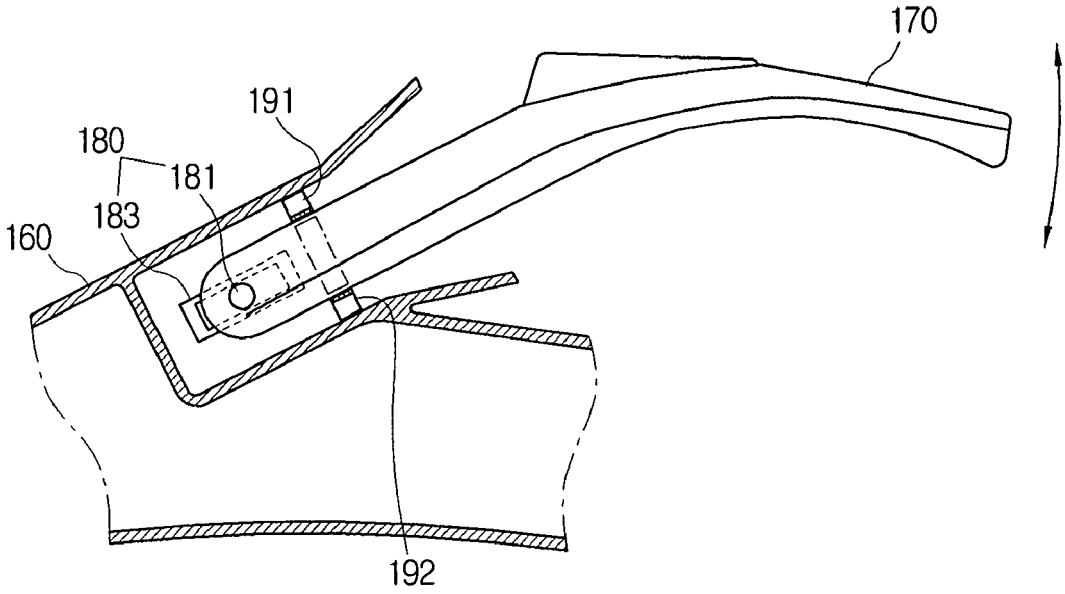
FIG. 3 is a cross-sectional side view of the handle assembly of FIG. 2.
Figure 4:
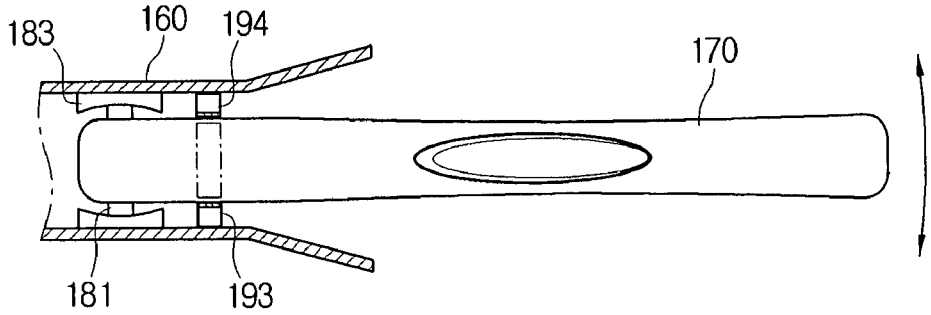
FIG. 4 is a cross-sectional plane view of the handle assembly of FIG. 2.

FIG. 2 is an exploded perspective view of the handle assembly 150, FIG. 3 is a cross-sectional side view of the handle assembly 150, and FIG. 4 is a cross-sectional plane view of the handle assembly 150.

The handle assembly 150 includes a housing 160, the handle 170, a connection unit 180, and an elastic unit 190.

The housing 160 forms an outward of the handle assembly 150.

The handle 170 is rotatable in all directions, including left, right, up, and down, and may be gripped by a user in order to move the vacuum cleaner.

The connection unit 180 connects the housing 160 with the handle 170 capable of rotating in all directions. The connection unit 180 includes a shaft 181 and a guide unit 183.

The shaft 181 is formed to penetrate the handle 170, and the handle 170 is able to rotate up or down about the shaft 181.

The guide unit 183 houses the shaft 181, in which the shaft 181 is capable of rotating, and the guide unit 183 is housed in the housing 160. The shaft 181 slidingly rotates in the guide unit 183, and the handle 170 is able thereby to rotate in left and right.

The shaft 181 and guide unit 183 support the handle 170 to rotate in all directions, including left, right, up, and down. The connection unit 180 disclosed above is provided as example in the exemplary embodiment of the present invention, but the connection unit 180 may have various forms, and only needs to connect the handle 170 so that the handle 170 is capable of rotating in all directions, including left, right, up, and down.

As the handle 170 rotates in all directions, including left, right, up, and down, a user may grasp the handle 170 in various positions without moving the brush pipe 120. Therefore, the angle at which a user's wrist or elbow is bent while performing cleaning is reduced. Accordingly, the user feels less strain and may use the brush pipe 120 more conveniently.

The elastic unit 190 elastically biases the handle 170 to a neutral position. In the neutral position, the handle 170 does not rotate at all in any direction, and is located at the center of the housing 160. That is, if the handle 170 is in the neutral position, the elastic unit 190 applies a net force of ON to the handle 170. The elastic unit 190 according to the exemplary embodiment of the present invention includes four elastic members 191, 192, 193, and 194 which are in contact with the handle 170.

If the handle 170 rotates upwards, the elastic member 191 elastically biases the handle 170 to the neutral position, if the handle 170 rotates downwards, the elastic member 192 elastically biases the handle 170 to the neutral position, if the handle 170 rotates to the left, the elastic member 193 elastically biases the handle 170 to the neutral position, and if the handle 170 rotates to the right, the elastic member 194 elastically biases the handle 170 to the neutral position.

In the exemplary embodiment of the present invention, the elastic members 191, 192, 193, and 194 are formed as leaf springs. However, the present invention should not be considered to be limited to such a configurations, and the elastic members 191, 192, 193, and 194 may alternatively be torsion springs, or compression springs.

Figure 5:
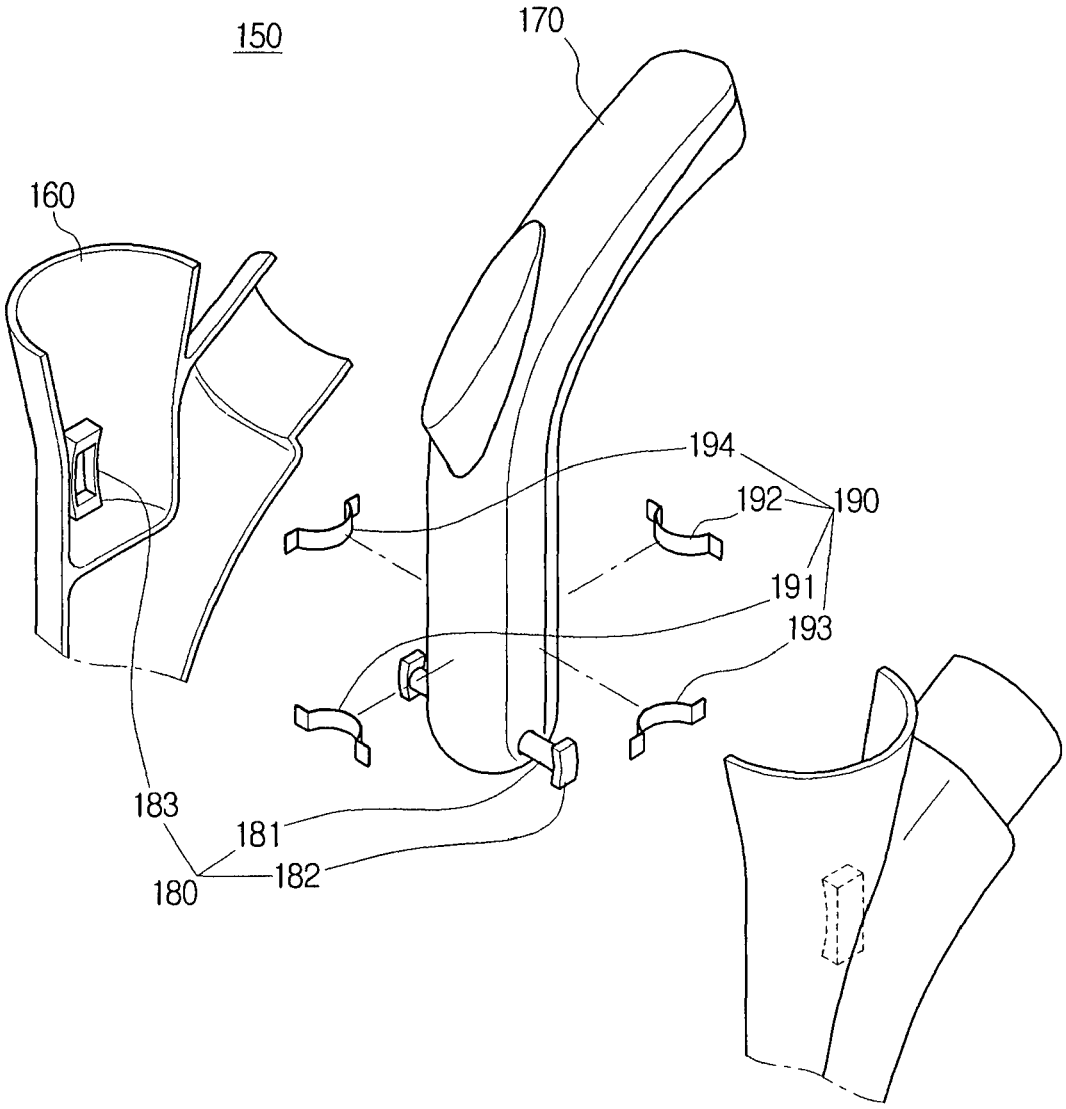
FIG. 5 is an exploded perspective view of a handle assembly according to an exemplary embodiment of the present invention.

FIG. 5 is an exploded perspective view of a handle assembly according to an exemplary embodiment of the present invention. The handle assembly 150 of FIG. 5 is substantially identical to that of FIG. 2, except that the handle assembly 150 of FIG. 5 additionally includes a flange 182 formed at both ends of the shaft 181. The flange 182 corresponds to the guide unit 183 in cross-section, and thus the flange 182 may be inserted into the guide unit 183, and is capable of sliding therein. As the flange 182 is capable of sliding in the guide unit 183, the shaft 181 is able to rotate, and the handle 170 is able to move to the left and right.

Figure 6:
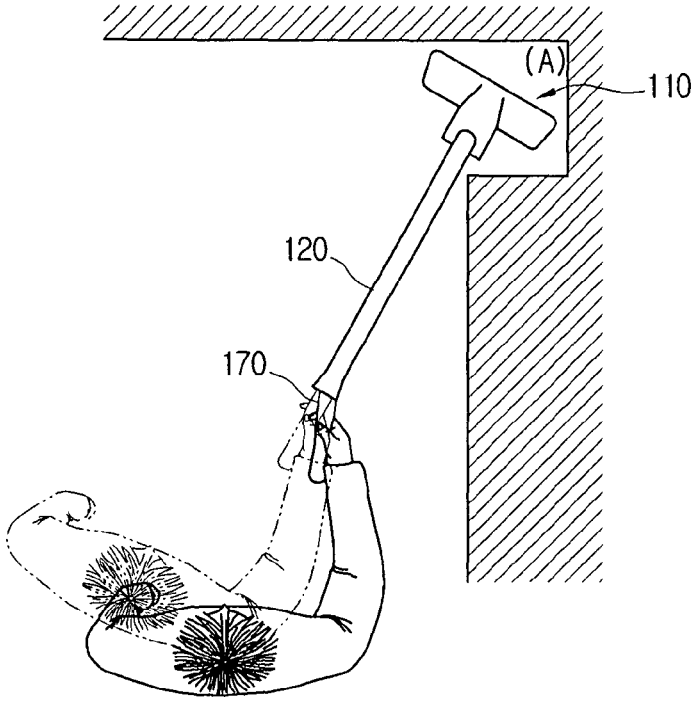
FIG. 6 is a plane view illustrating the state of the vacuum cleaner of FIG. 1 while in use.

FIG. 6 is a plane view illustrating the state of the vacuum cleaner while in use according to an exemplary embodiment of the present invention.

Referring to FIG. 6, the handle 170 rotates to the left and right, so a user can conveniently clean corners (A). If the handle 170 is fixedly connected to the brush pipe 120, a user should move his or her arm to the position shown in the dotted line to clean the corner (A). However, as the handle 170 of the vacuum cleaner according to the exemplary embodiment of the present invention is rotatable to the left and right, it is unnecessary for a user to move to the corner (A). The user can conveniently handle the brush pipe 120 by using the vacuum cleaner according to the exemplary embodiment of the present invention.

Figure 7:
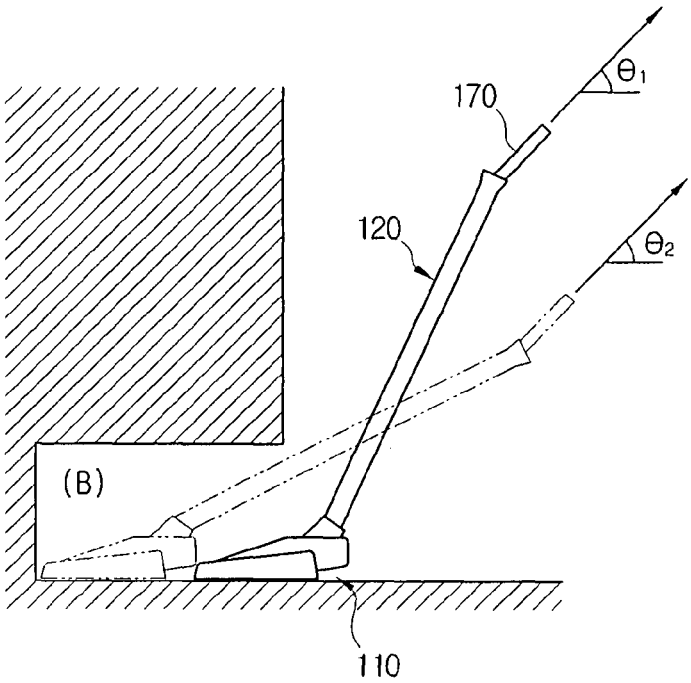
FIG. 7 is a side view illustrating the state of the vacuum cleaner of FIG. 1 while in use.

FIG. 7 is a side view illustrating the vacuum cleaner of FIG. 1 while in use.

Referring to FIG. 7, a user should move the brush pipe 120 vigorously in order to clean a corner (B). If the handle 170 is fixedly connected to the brush pipe 120, the user should bend his or her wrist or elbow to an inconvenient position. However, the handle 170 of the vacuum cleaner according to the exemplary embodiment of the present invention is rotatable up and down. Accordingly, even when the brush pipe 120 is bent at an extreme angle, the angle between the handle 170 and the surface hardly varies. That is, the angle $\theta_1$ between the handle 170 and the surface when the brush assembly is positioned as shown by the solid line is approximately the same as the angle $\theta_2$ between the handle 170 and the surface when the brush assembly is positioned as shown by the dotted line. Accordingly, a user can conveniently clean the corner (B) without substantial wrist and elbow movement.

According to the handle assembly of the exemplary embodiment of the present invention, the handle rotates in all directions, including left, right, up, and down. Therefore, the user's wrist and elbow are bent at a slight angle, and the user feels less strain in his or her joints.

A user can thus handle the brush pipe conveniently by rotating the handle.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A handle assembly, comprising:

a housing;

a handle which is capable of being gripped by a user;

a connection unit which connects the housing with the handle to rotate in all directions; and an elastic unit which elastically biases the handle to a neutral position.

2. The handle assembly of claim 1, wherein the connection unit comprises:

a shaft which penetrates the handle; and a guide unit which houses the shaft in a rotatable manner.

3. The handle assembly of claim 2, wherein the connection unit further comprises:

a flange which is inserted into the guide unit, and is formed at both ends of the shaft.

4. The handle assembly of claim 1, wherein the elastic unit comprises:

four elastic members which are in contact with the handle.

5. The handle assembly of claim 4, wherein the elastic member is a leaf spring.

6. The handle assembly of claim 4, wherein the elastic member is a torsion spring.

7. The handle assembly of claim 4, wherein the elastic member is a compression spring.

8. A cleaner, comprising:

a brush assembly which contacts a surface being cleaned, and draws in dust-laden air from the surface;

a brush pipe which extends from the brush assembly; and a handle assembly which is mounted on an end of the brush pipe, wherein the handle assembly comprises:

a housing;

a handle which is capable of being gripped by a use;

a connection unit which connects the housing to the handle to rotate in all directions; and an elastic unit which elastically biases the handle to a neutral position.

9. The cleaner of claim 8, wherein the connection unit comprises:

a shaft which penetrates the handle; and a guide unit which houses the shaft in a rotatable manner.

10. The cleaner of claim 9, wherein the connection unit further comprises:

a flange which is inserted into the guide unit, and is formed at both ends of the shaft.

11. The cleaner of claim 8, wherein the elastic unit comprises four elastic members.

12. The cleaner of claim 11, wherein the elastic member is a leaf spring.

13. The cleaner of claim 11, wherein the elastic member is a torsion spring.

14. The cleaner of claim 11, wherein the elastic member is a compression spring.

* * * * *